United States Patent [19]

Berkley

[11] 4,319,458

[45] Mar. 16, 1982

[54] MULTIPLE PRESSURE BOILER WITH ENERGY RECOVERY SYSTEM

[76] Inventor: James R. Berkley, 585 Hardendorf Ave., NE., Atlanta, Ga. 30307

[21] Appl. No.: 97,533

[22] Filed: Nov. 26, 1979

Related U.S. Application Data

[63] Continuation-in-part of Ser. No. 32,397, Apr. 23, 1979, abandoned.

[51] Int. Cl.[3] ..... F28B 7/00

[52] U.S. Cl. ..... 60/693; 60/670; 122/1 A; 122/138; 110/217

[58] Field of Search ..... 122/1 A, 136 R, 138; 110/216, 217; 60/643, 645, 685, 690, 693, 670, 692; 431/157, 353

[56] References Cited

U.S. PATENT DOCUMENTS

| | | | |
|---|---|---|---|
| 268,176 | 11/1882 | Blanchard | 60/678 X |
| 642,943 | 2/1900 | Whitney et al. | 60/690 |
| 3,606,847 | 9/1971 | Reilly | 110/216 |
| 3,716,967 | 2/1973 | Doyle, Jr. et al. | 110/216 X |
| 3,788,385 | 1/1974 | Delahunty | 60/690 X |
| 3,830,063 | 8/1974 | Morgan | 60/645 |
| 3,835,650 | 9/1974 | Chesmejef | 60/670 X |

FOREIGN PATENT DOCUMENTS

| | | | |
|---|---|---|---|
| 221779 | 6/1959 | Australia | 122/1 A |

*Primary Examiner*—Allen M. Ostrager
*Assistant Examiner*—Stephen F. Husar
*Attorney, Agent, or Firm*—James B. Middleton

[57] ABSTRACT

A multiple pressure boiler is disclosed having a plurality of boiler sections, each section operating at a successively lower temperature and lower pressure than the preceding section. The intake air for the firebox is heated by the flue gases, then superheated by the steam, to provide heated air for combustion, and the steam from the highest pressure section is superheated by the flue gases prior to its being used in a steam turbine or other steam engine. The fuel for the firebox is heated initially by being used as the coolant for a steam condenser, and is superheated by superheated steam from the heat exchanger. It is contemplated that a sufficient quantity of heat will be removed from the flue gases that the solids will precipitate out, and the gas will be substantially at ambient temperature. If heat must be discarded from the system, a water jacket is used in conjunction with a second condenser, the water jacket being cooled by a pond, water being fed from the bottom of a well in the pond, through the cooling jacket and to a sprinkler in the pond. The system is therefore an energy efficient system that will return clean, low temperature gas to the atmosphere.

13 Claims, 6 Drawing Figures

MULTIPLE PRESSURE BOILER WITH ENERGY RECOVERY SYSTEM

CROSS-REFERENCE TO RELATED APPLICATION

This application is a continuation-in-part of the application of the same inventor entitled "Heat Exchanger for Flues," filed on Apr. 23, 1979, under Ser. No. 32,397, now abandoned.

FIELD OF THE INVENTION

This invention relates generally to steam boilers and the like, and is more particularly concerned with a multiple pressure steam boiler having a high efficiency in heat useage.

BACKGROUND OF THE INVENTION

Steam boilers have been used for a considerable number of years, the most common variety of steam boiler including a fire box in which a pipe takes a tortuous path through the fire box, the pipe carrying water which is boiled to make steam. This variety of boiler has a large amount of wasted heat, largely because the hot flue gases are in contact with the pipe for a relatively short time, so the water does not absorb a large percentage of the heat. Another form of steam boiler includes a tank of water having a plurality of flue pipes extending through the tank. In this variety of boiler, a fuel is burned, and the hot flue gases pass through the plurality of pipes extending through the tank of water, the water absorbing heat from the flue gases for the full length of time required for the hot gases to pass entirely through the tank of water. Even with this variety of steam boiler, the flue gases contain a considerable amount of heat after passing entirely through the tank of water so that much heat is wasted. Also, since the flue gases are rather hot as they exit from the tank, such a system contains a large amount of combustion products in suspension in the hot gases; and, this material, along with the hot gases, is generally dumped into atmosphere. Such a system causes considerable pollution of the atmosphere, as well as the waste of heat and the waste of fuel or other energy source required to generate the heat.

There have been some attempts to utilize a portion of the wasted heat from a steam boiler, these efforts primarily taking the form of an additional heat exchanger placed in the flue in order to extract additional heat from the flue gases. While such arrangements do indeed extract additional heat from the flue gases, the flue gases are still quite hot after passing over the additional heat exchanger, and the flue gases generally still contain solid particles in suspension. Thus, a person operating a steam boiler has generally been required to install additional equipment to prevent further pollution of the atmosphere, and this additional equipment frequently requires additional energy. The result is that the wasted energy in the initial steam boiler causes an additional waste of energy in order to prevent pollution of the atmosphere.

SUMMARY OF THE INVENTION

The present invention overcomes the above mentioned and other difficulties with the prior art steam boilers by providing a multiple pressure steam boiler having a plurality of discrete stages or sections, each successive stage of the boiler being operated at a lower pressure than the preceding stage, and at a lower temperature. A heat source provides heat which passes through boiler tubes in the first stage, then through successive additional stages of the multiple pressure boiler so that the one source of heat provides the required heat for all of the plurality of stages of the boiler. Intermixed with the multiple stages of the boiler, additional heat exchangers are provided to extract heat from the hot gases passing through the multiple stages of the boiler, the heat so removed being returned to the system to provide increased efficiency in the system. An additional feature of the present invention is the use of the fuel for the fire box as a means for cooling the steam after use, and the further heating of the fuel so that the fire box is fed with both heated fuel and heated air for maximum efficiency in combustion of the fuel. The present invention further contemplates the use of a filtering means for removing the solid particulate materials from the gases to be discharged, and thereafter discharging the gases approximately at ambient temperature.

BRIEF DESCRIPTION OF THE DRAWINGS

These and other features and advantages of the present invention will become apparent from consideration of the following specification when taken in conjunction with the accompanying drawings in which:

FIG. 1 is a partially schematic representation showing a multiple pressure boiler made in accordance with the present invention in conjunction with a system for utilizing the boiler in an energy efficient manner, and further showing optional additional cooling means for the low pressure side of the turbine or the like;

DESCRIPTION OF THE PREFERRED EMBODIMENT

Figure 1:
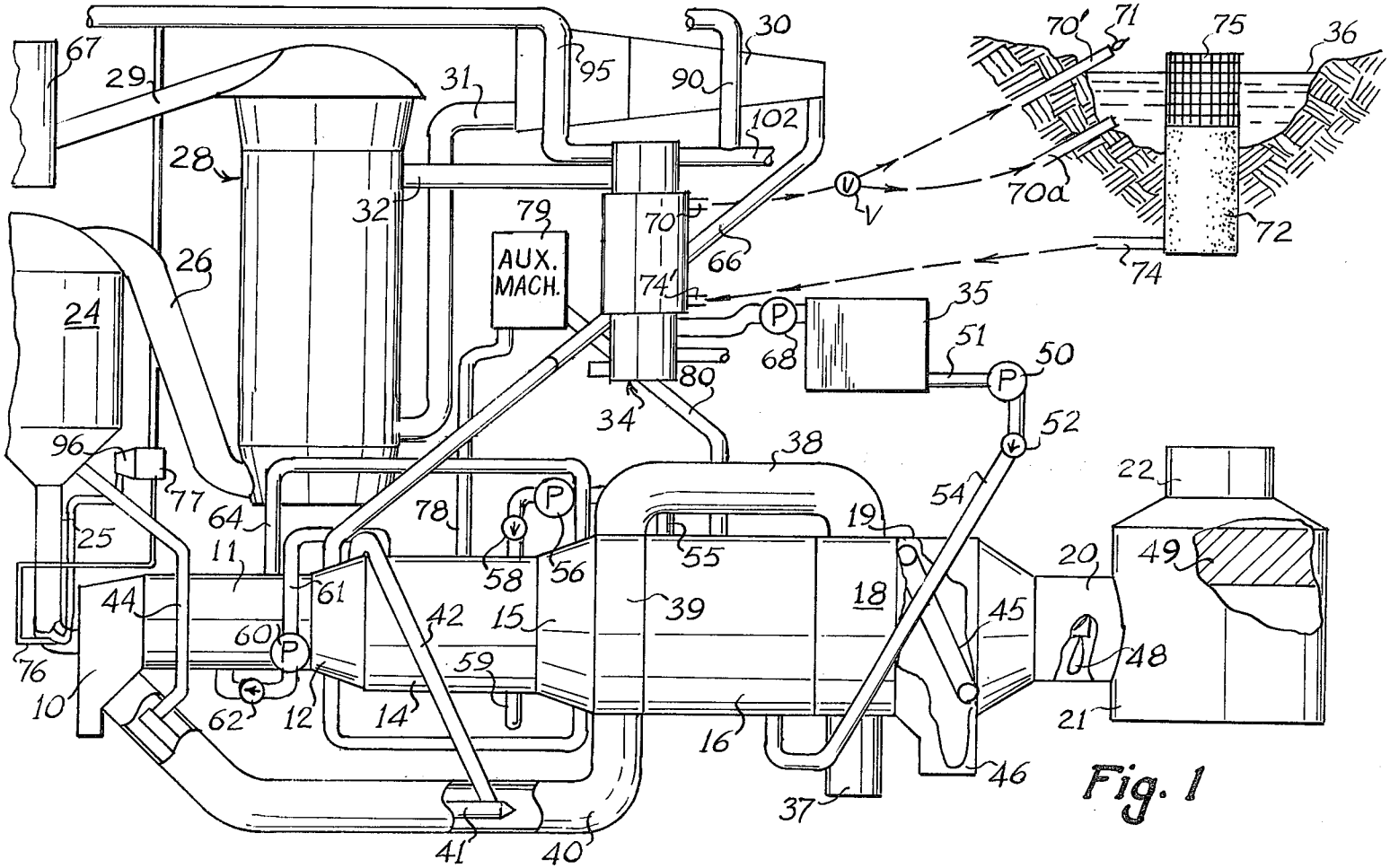

Referring now more particularly to the drawings, and to that embodiment of the invention here chosen by way of illustration, FIG. 1 discloses a fire box 10 connected to a first boiler section 11, the boiler section 11 being connected through a transition member 12 to a second boiler section 14. Similarly, the boiler section 14 is connected through a transition member 15 to a third boiler section 16. The third boiler section 16 is connected through a final heat exchanger 18 to a solids separator 19, then through a fan duct 20 to a filter house 21. The filter house 21 is provided with a stack 22.

The fire box 10 is fed from a fuel tank 24, the tank 24 having a downspout 25 through which fuel is fed to the fire box 10. Fuel is placed in the tank 24 by means of a conveying arrangement 26 connected to the bottom of a condenser unit 28, the top of the condenser unit 28 being fed by an appropriate conveying means 29. As will be discussed in more detail hereinafter, the conveying means 29 may convey oil, crushed coal or other appropriate fuel for the fire box 10.

The condenser 28 acts as a condenser for the exhaust from a turbine 30, the turbine 30 being shown schematically. It will be realized that any known form of mechanical power device can be utilized to convert the steam into mechanical energy, a turbine being one form of well known device chosen for purposes of illustration. It will be seen that the low side, or vacuum side, of the turbine 30 is connected to the condenser 28 by a pipe 31, and the opposite side of the condenser 28 is here shown as connected, through a pipe 32, to a second condenser 34, the second condenser 34 being connected to a tank 35. From the tank 35, the condensed steam is returned to the boiler system as will be discussed in detail hereinafter.

Also shown in FIG. 1 of the drawings, there is a cooling pond 36. Though it is contemplated that no such cooling device will be required, the arrangement shown, and to be discussed in detail hereinafter, is a highly desirable arrangement in the event additional cooling is required for the system.

In discussing the system of the present invention, the device will be separated into the various fluid systems to prevent confusion and to explain the system and its advantages with greater clarity. Also, attention is directed to FIGS. 1 and 2 for a full understanding of the system.

Looking first at the intake air system, it will be understood that the intake pipe 37 receives ambient air which is passed through the final heat exchanger 18 to be warmed by the flue gases. Since the fire box 10 is on the extreme opposite end of the apparatus disclosed, it will be understood that the flue gases are relatively cool. Nevertheless, so long as the ambient air is below the temperature of the flue gases at this late stage, the ambient air will be warmed and the flue gases will be further cooled. After the air passes through the heat exchanger 18, the air travels through a connector pipe 38 and through another heat exchanger 39. It will be seen that the heat exchanger 39 is between the transition piece 15 and the final boiler section 16 so that the flue gases at this point will be somewhat warmer than they were in the heat exchanger 18. As a result, the air passing through the pipe 38 and the heat exchanger 39 will be further heated by flue gases passing through the heat exchanger 39.

Figure 2:
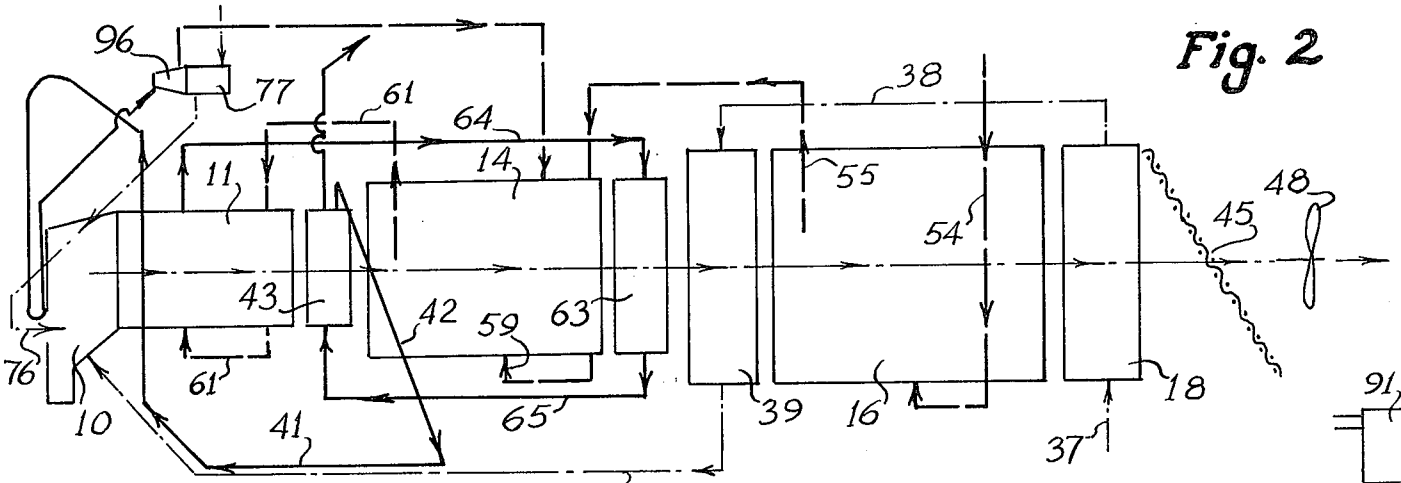
FIG. 2 is a schematic representation showing the multiple pressure stages of the boiler of the present invention in conjunction with the other heat exchangers and the fluid flow systems.

As the air exits from the heat exchanger 39, the air passes into a pipe 40 which is connected directly to the fire box 10 to provide the necessary air for combustion of fuel. Within this final pipe 40, it will be seen that there is a generally centrally located pipe 41, the pipe 41 having a line 42 connected at the upstream end, and a pipe 44 connected at the downstream end. The pipe 42 is connected to the transition member 12; and, as is shown in FIG. 2, the transition member 12 includes a heat exchanger 43 to be used as a superheater for steam. Thus, the pipe 42 carries superheated steam, the superheated steam being passed through the pipe 41 and out through the pipe 44. As a result, it will be understood that the air passing through the pipe 40 will be heated by the superheated steam so that the air, at the time for combustion, is quite hot.

At this point, it will be understood that the intake air is mixed with the fuel and becomes part of the flue gases. Continuing with the air, therefore, it will be understood that fuel is burned in the firebox 10 and the resulting flue gases pass through the boiler section 11, and throughout the sequence previously described. Each of the pieces of apparatus in the previously described system removes part of the heat from the hot flue gases so that, at the solids separator 19 there is a belt-like screen 45 angularly disposed within the solids separator housing 19. The screen 45 will be a relatively fine mesh screen so that solids entrained in the flue gases will engage the screen and not pass therethrough. As a result, the solids will fall into the pit 46 while the air will pass through the screen 45 and into the fan duct 20. The screen 45 may be moved continuously to present a fresh surface to the flue gases, and the ashes will be continuously dumped into the ash pit 46 as the screen rotates.

With the duct 20, there is a fan 48 or other air moving means which will move the air through the fan duct and into the filter house 21. The filter house 21 includes a body of filtering material 49 which will remove any final remaining pollutants, and the air containing virtually no solids will be returned to the atmosphere through the stack 22. It is contemplated that the temperature of the air emitted from the stack 22 will approximate ambient temperature.

It will therefore be seen that ambient air enters the pipe 37, passes through heat exchangers to be heated, and the heated air is utilized for combustion of fuel. The air becomes part of the flue gases and passes through the various sections of the boiler and the various heat exchangers to remove the heat from the air for use in the system, the air is filtered and returned to the atmosphere.

Those skilled in the art will realize that, in conventional fire boxes such as the fire box 10, a blast of air or other gas is used to assist in atomization of the fuel as the fuel is placed into the fire box. In the present apparatus the blast of air is provided through a tubing 76 leading from an air compressor 77. The input to the air compressor 77 is heated air, as will be discussed later; therefore, the compressed air to be used as atomizing air in the fire box will be very hot.

The next circuit to be discussed is the water circuit. While the circuit is ideally a closed circuit, a reasonable place to start is the tank 35 which is a liquid water tank for feeding water to the boilers as required. Also, any make-up water would be added to the tank 35 to get it into the system. There is a pump 50 which removes water from the tank 35 through a line 51, the pump directing the water through a check valve 52 and through a pipe 54 which is connected to the bottom of the final, low pressure, boiler section 16. Since the boiler 16 is under some pressure, it will be understood that the check valve 52 is required to prevent back-pressure on the pump 50 and onto the tank 35.

Since the boiler section 16 is far removed from the firebox 10, it will be understood that flue gases passing therethrough are relatively cool, but they will be above the temperature of incoming water so that the water will be heated by the flue gases. Water is then pumped from the top of the boiler section 16, through the pipe 55 by a pump 56 which discharges the water through a check valve 58, then into the bottom of the boiler section 14. Briefly, it should be understood that the boiler section 14 is closer to the fire box 10, and will be at a higher temperature and higher pressure than the boiler section 16. As a result, the check valve 58 is required to prevent back-flow through the pump 56 and pipe 55.

Similarly, water is pumped by a pump 60 through a pipe 61 to remove water from the top of the boiler section 14, the pump 60 then passing the water through a check valve 62 and into the bottom of the boiler section 11. The water has therefore passed from the tank 35 or other source of water, through the low pressure boiler section 16 for initial heating, then to the intermediate boiler section 14 for additional heating, and from there to the boiler section 11 for final heating.

It will thus be seen that, in the boiler section 11, the water is boiled, and sufficient heat is added that a portion of the water is converted into steam, the steam passing from the boiler section 11 through the pipe 64. The pipe 64 then connects to the transition piece 15 which includes a heat exchanger 63 so that the steam is super-heated. From the heat exchanger 63, the steam passes through a pipe 65 and to the heat exchanger 43 in the transition member 12 for additional superheating of the steam. After the steam passes through the heat exchanger 43, the steam is directed through a pipe 66 and to the turbine 30 or other apparatus for utilizing the steam to produce mechanical energy. It will also be remembered that the pipe 42 is connected to the heat exchanger 43 so that a portion of the superheated steam is used to heat the incoming air in the pipe 40.

After the superheated steam passes through the various stages of the turbine 30, the steam will finally pass through the pipe 31 and into the condenser 28.

While it is conventional to utilize a condenser on the vacuum side of a steam turbine, the present arrangement is considered novel in that the cooling medium for condensing the steam is the fuel to be burned in the fire box 10. Also, as a further feature of the invention, a second condenser 34 connected in series with the first condenser 28 may be used. Though the second condenser 34 does not utilize fuel as the coolant, the heat removed by the second condenser 34 is used in the system so the heat is not wasted.

To achieve the cooling in the condenser 28, the steam is passed through the pipe 31 and into the body of the condenser 28. The fuel is brought to the condenser 28 from the fuel source 67 by the conveying means 29 and dispensed into the upper part of the condenser 28, so the fuel passes through a plurality of heat exchange pipes to cool steam passing therearound. When the steam reaches the upper part of the condenser 28, the steam will have been considerably cooled so that final condensation can take place in the second condenser 34.

The second condenser 34 as here shown uses both ambient air and fresh water as coolants. For this purpose, the condenser 34 is divided internally, as will be discussed later, so that a portion of the condenser 34 is cooled by air, and a different portion is cooled by water.

The second condenser 34 receives the partially cooled steam from the condenser 28 through the pipe 32. The steam passes down through the condenser 34 while the coolant fluids flow from bottom to top to cool the steam. In this second condenser 34, it is contemplated that the steam will be cooled sufficiently to be condensed to water, and the water will pass through the pipe 68 to the tank 35.

If there is excess heat in the system that must be discarded rather than used, the second condenser 34 is the place where the heat can best be removed. It will be realized that sufficiently fast condensation of the steam from the turbine 30 is important to keep the vacuum side of the turbine at sufficiently low pressure to achieve an acceptably high pressure differential between the pipe 66 and the pipe 31 for maximum efficiency of the turbine. Thus, if the two condensers do not sufficiently cool the steam, additional cooling means must be provided. The additional cooling means is here shown as including a water jacket 69 surrounding the condenser 34.

To achieve sufficient cooling using the water jacket 69, it is contemplated that the cooling pond 36 would be used. Though no pumps or the like are here illustrated it will readily be recognized that some means must be utilized to move the water from the pond 36 through the cooling jacket 69 and to the pond 36.

As here shown, the upper end of the cooling jacket 69 has the pipe 70 for discharge of water therefrom, the pipe 70 being connected to a pipe 70', the pipe 70' being located at the cooling pond 36 and provided with an appropriate spray nozzle 71. Thus, as water is pumped through the water jacket 69 and out the pipe 70 and into the pipe 70', the water will be sprayed through the spray nozzle 71 into the air for cooling of the water. The water will fall into the pond 36 for additional cooling depending on ambient temperature.

It will be seen that there is a well 72 in the bottom of the pond 36, the well 72 having a pipe 74 extending therefrom, the pipe 74 being connected to the pipe 74' for input to the water jacket 69. The well 72 has an appropriate screen 75 to preclude debris.

With the above described arrangement, it will be seen that the water will be cooled somewhat by being sprayed into the air as is conventional; then, water from the pond will pass into the well 72 to be considerably underground where additional heat can be discharged to the earth. From the lowest point of the well 72, the pipe 74 directs water back to the cooling jacket 69.

In very cold weather, it will be understood that spraying of the water through the pipe 70' may not be required; further, if the air is sufficiently cold, the water may freeze. Thus, an alternate outlet pipe **70*a* is provided. A valve V is used to select the appropriate pipe and, when the pipe 70*a* is selected, water will be released under the water of the pond 36**.

Looking next at the fuel system it will be understood that oil, finely crushed coal, or other fuel is fed by conveying means 29 into the upper portion of the condenser 28. The fuel passes through the condenser 28 to cool steam from the turbine 30, and the fuel collects in the bottom of the condenser 28. From the condenser 28, the conveying means 26 conveys the fuel to the upper portion of the tank 24 which is the storage tank for the fuel. The steam line 44, after leaving the pipe 40, enters the tank 24 and extends down the downspout 25 which conveys the fuel from the tank 24 to the fire box 10. The steam line 44 therefore provides additional heat for the incoming fuel as the fuel passes through the downspout 25.

Figure 6:
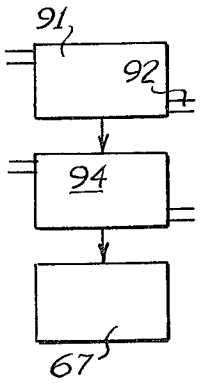

If the fuel for the apparatus is coal, the coal must generally be wahsed and dried before being used. As is illustrated schematically in FIG. 6, in conjunction with FIG. 1, the heated water passing through the pipe 90 from the second condenser 34 is used in the coal washer 91 to wash the coal, the water then being discharged through the pipe 92. The coal will therefore be washed and partially heated.

The coal passes from the washer 91 to the coal dryer 94. Here, the heated air from the second condenser 34 is directed through the pipe 95 to the coal dryer 94. This heated air is used to dry the coal, and further heat the coal, then is discharged. The coal is therefore washed and dried, and has been considerably warmed. The coal is therefore ready to go to the coal crusher 67 from which it will be delivered to the condenser 28 as described.

Obviously, if gas or fuel oil is used as the fuel, the foregoing steps will be omitted. In any case, however, it is contemplated that the fuel will be heated prior to combustion for more nearly complete combustion.

Returning now to the air compressor 77, it will be seen that the compressor 77 is driven by a steam turbine 96, and the steam to operate the turbine 96 is from the line 44. After the steam in the pipe 44 has heated the fuel, the steam will have enough power to operate a turbine; thus, the arrangement shown makes use of some of this remaining power. On the low pressure side of the turbine, the steam is directed to the intermediate section 14 of the boiler.

The incoming air for the compressor 77 is taken from the pipe 95, which is connected to the second condenser as previously discussed. The air is already heated, so the compressing of this air will raise the temperature of the air prior to use as atomizing air.

One additional feature of the present invention includes a line 78 extending from the intermediate boiler section 14. It will be realized that the boiler section 14 is hot enough that the boiler is under pressure, and the line 78 would direct steam from the intermediate boiler 14 to operate auxiliary machinery here designated at 79. The auxiliary machinery may include the various pumps necessary for operating the system, and may include an electric generator or the like to provide power for controls, general lighting and the like. From the auxiliary machinery at 79, the steam would be returned through a pipe 80 to the lowest pressure, or final, stage 16 of the multiple pressure boiler.

Figure 3:
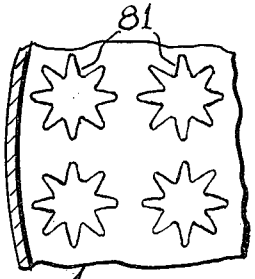
FIG. 3 is a fragmentary cross-sectional view taken generally transversely through the boiler of the present invention, and showing the boiler tubes.

Looking now at FIG. 3 of the drawings, it will be seen that a portion of a boiler is illustrated to show the flue pipes for heat transfer. As is illustrated in FIGS. 1 and 2 of the drawings it will be seen that the first section of the boiler, which is also the highest pressure section of the boiler, is the smallest in diameter. In successive stages, the diameter of the boiler increases and the pressure in the boiler decreases. The increase in the diameter is to provide a larger surface area for the cooler flue gases so that more heat can be removed from the flue gases due to the larger surface area. While only a single figure is shown, it will be understood that all the boiler sections, and all of the heat exchangers, utilize similar construction, the flue gases passing through the same flue pipes so that the fluid in contact with the outside of the pipes can remove heat from the flue gases.

With the above in mind, it will be seen that the internal construction includes the flue pipes 81 having a central opening therethrough with a plurality of finger-like extensions circumferentially of each pipe. This structure is described in detail in the above identified co-pending application, and no further description is thought to be necessary.

Figure 4:
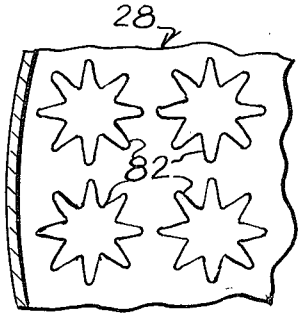
FIG. 4 is a fragmentary cross-sectional view through the first condenser shown in FIG. 1.

FIG. 4 of the drawings shows a similar figure to illustrate the condenser 28. It will be seen that the condenser 28 also includes pipes such as the pipe 81, the fuel passing through the pipes here designated at 82, while the steam passes around the outside of the pipes 82 to be cooled by the relatively cool fuel passing through the pipes 82.

Figure 5:
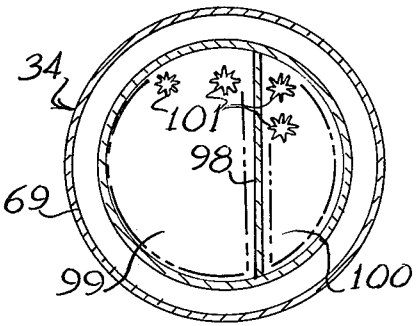
FIG. 5 is a transverse cross-sectional view showing the internal construction of the second condenser shown in FIG. 1; and, FIG. 6 is a schematic illustration showing the flow of fuel in the event coal or the like is utilized as the fuel.

FIG. 5 of the drawings illustrates the construction of the second condenser 34. As has been previously stated, the condenser 34 is divided into two sections by a plate 98. The air section 99 is somewhat larger than the water section 100 because water will remove heat more efficiently than air, so less surface area is required.

In each section of the condenser 34, there is a plurality of heat exchange pipes 101, the pipes 101 being of the same construction as the pipes 81 and 82 in the boiler and the first condenser 28. The water jacket 69 surrounds the entire second condenser 34 as shown for removal of additional heat if required.

Due to the novel use and construction of the second condenser 34, it will be seen that heated air is provided for use in the coal dryer, and as input to the compressor 77 for atomizing air. Additionally, heated water is provided for use in the coal washer, and part of the water may be directed through the branch 102 for general use in offices or elsewhere. In any case, the arrangement provides a source of both hot air and hot water from what may otherwise become wasted heat.

From the foregoing, it will now be understood that the multiple pressure boiler of the present invention provides an arrangement whereby fuel is burned, and the flue gases are passed through multiple sections of a boiler to remove a very large amount of heat from the flue gases, and to place the heat into the water to assist in turning the water into steam. The hot flue gases are further used to superheat the steam for efficient use of the steam in conventional mechanical devices.

The flue gases are also used for preheating the air for combustion of fuel, and additional heat is removed from the system and used to preheat the fuel itself so that both the fuel and the air are well heated prior to actual combustion. All heat exchange apparatus utilizes the novel flue pipe construction for maximum heat transfer. While it is contemplated that virtually all of the heat will be removed from the flue gases so that the flue gases can be returned to the atmosphere substantially at ambient temperature, there is also an ingenious provision for further removing heat from the system when some heat must be discarded.

The present invention contemplates the use of all the heat generated. While 100% efficiency is not possible due to the various unavoidable losses, the system of the present invention is arranged to make use of heat rather than to discard heat. With this in mind, it will be understood that the water in the tank 35 will be very hot, but liquid rather than steam. Ideally, the water would be at 212° F. (100° C.) so that the only heat to be replaced will be the latent heat, or the heat of varporization. This can not be achieved in practice, but the water should be as close to the boiling point as practicable in the given installation.

It will of course be understood by those skilled in the art that the particular embodiment of the invention here presented is by way of illustration only, and is meant to be in no way restrictive; therefore, numerous changes and modifications may be made, and the full use of the equivalents resorted to, without departing from the spirit or scope of the invention as defined in the appended claims.

I claim:

1. A multiple pressure boiler, comprising means for producing hot gases, a first boiler section including heat exchange means for receiving said hot gases and transferring heat from said hot gases to water in said first boiler section to raise the water in said first boiler section to a first temperature and cause said first boiler section to be at a first pressure, a second boiler section including heat exchange means for receiving said hot gases from said first boiler section and transferring heat from said hot gases to water in said second boiler section to raise the water in said second boiler section to a second temperature and cause said second boiler section to be at a second pressure, means for admitting water to said second boiler section for heating, means for removing heated water from said second boiler section and admitting said heated water to said first boiler section, and second temperature being above the boiling point of water and said second pressure being above atmospheric pressure, said first temperature being above said second temperature and said first pressure being above said second pressure.

2. A multiple pressure boiler as claimed in claim 1, and including a plurality of heat exchangers located such that said hot gases pass through all of said plurality of heat exchangers, said plurality of heat exchangers being adapted to remove heat from said hot gases for use in said multiple pressure boiler.

3. A multiple pressure boiler as claimed in claim 2, at least one heat exchanger of said plurality of heat exchangers being a steam superheater for superheating steam from said first boiler section.

4. A multiple pressure boiler as claimed in claim 2, and including a solids separator for receiving said hot gases after said hot gases have passed through all said boiler sections, and all of said plurality of heat exchangers, fan means for moving said hot gases, and a filter for removing remaining solid material from said gases.

5. A multiple pressure boiler as claimed in claim 2, one heat exchanger of said plurality of heat exchangers constituting an intake air heat exchanger for receiving said hot gases after said hot gases pass through the second boiler section, said intake air heat exchanger being adapted to transfer heat from said hot gases to intake air for said means for producing hot gases.

6. A multiple pressure boiler as claimed in claim 5, and including pipe means for carrying intake air from said intake air heat exchanger to said means for producing hot gases, and including superheater means in said pipe means for additionally heating said intake air.

7. A multiple pressure boiler as claimed in claim 1, said means for producing hot gases including a firebox, a source of fuel for said firebox, and further including a means for heating said fuel, and means for superheating said fuel prior to placing said fuel in said firebox.

8. A multiple pressure boiler as claimed in claim 7, said means for superheating said fuel including a steam line receiving steam from said first boiler section, a third engine having a high pressure side connected to said steam line, and a low pressure side connected to said second boiler section.

9. A multiple pressure boiler as claimed in claim 7, and further including an engine for utilizing steam from said first boiler section, said engine including a low pressure side from which steam is exhausted, at least one condenser in communication with said low pressure side for receiving steam, said condenser including heat exchange means for cooling said steam, and means for passing said fuel through said condenser, said condenser constituting said means for heating said fuel.

10. A multiple pressure boiler as claimed in claim 9, and including a second engine for utilizing steam from said second boiler section, said second engine including a low pressure side from which steam is exhausted, a third boiler section including heat exchange means for receiving said hot gases from said second boiler section and transferring heat from said hot gases to water in said third boiler section to raise the water in said third boiler section to a third temperature below said second temperature and above the boiling point of water and cause said third boiler section to be at a third pressure below said second pressure and above atmospheric pressure, said low pressure side of said second engine being connected to exhaust steam into said third boiler section.

11. A multiple pressure boiler as claimed in claim 9, and further including a spout for conducting said fuel to said firebox, and a superheater in said spout for superheating said fuel.

12. A multiple pressure boiler as claimed in claim 11, said at least one condenser being a first condenser of a plurality of condensers, and further including a second condenser connected in series with said first condenser, said second condenser having an air section cooled by ambient air and a water section cooled by water.

13. A multiple pressure boiler as claimed in claim 12, and including a cooling jacket surrounding said second condenser, a cooling pond having a well in the bottom thereof, means for carrying water from said well to said cooling jacket, a sprinkler at said pond, and means for carrying water from said cooling jacket to said sprinkler.

* * * * *